US005846138A

United States Patent [19]

Borden et al.

[11] Patent Number: 5,846,138

[45] Date of Patent: Dec. 8, 1998

[54] METHOD AND APPARATUS FOR BOWLING IN MINIMAL AMBIENT LIGHT

[76] Inventors: Fred L. Borden, 580 E. Cuyahoga Falls Ave., Akron, Ohio 44310; James F. Mansfield, 2077 Penguin Dr., Akron, Ohio 44219; Jerrylin D. Edwards, 42 Gloucester Ct., Akron, Ohio 44313

[21] Appl. No.: 459,417

[22] Filed: Jun. 2, 1995

[51] Int. Cl.[6] ..... A63D 1/00

[52] U.S. Cl. ..... 473/54; 473/115; 473/125; 273/DIG. 24

[58] Field of Search ..... 473/54, 55, 58, 473/115, 116, 118, 125; 273/DIG. 24; 250/483.1, 484.1; 40/542, 543

[56] References Cited

U.S. PATENT DOCUMENTS

| | | | |
|---|---|---|---|
| 3,301,558 | 1/1967 | Clapham . | |
| 3,917,264 | 11/1975 | Davidson . | |
| 3,971,560 | 7/1976 | Panosh | 273/30 |
| 4,846,475 | 7/1989 | Newcomb et al. | 273/128 R |
| 4,982,601 | 1/1991 | Troxell | 73/104 |
| 5,330,195 | 7/1994 | Gulick | 273/213 |
| 5,370,390 | 12/1994 | Swanson | 273/56 |

OTHER PUBLICATIONS

American DJ Supply, Inc., "Hightech Effects" Brochure, 2 Sheets, 1991.
Perry–Austen International Inc. Catalogue, pp. 11–12.
Martin General Catalogue, 4 Sheets.
Wildfire Inc. Catalogue, 7 Sheets.

*Primary Examiner*—William M. Pierce
*Attorney, Agent, or Firm*—Webb Ziesenheim Bruening Logsdon Orkin & Hanson, P.C.

[57] ABSTRACT

Sporting apparatus and environment are disclosed for playing a sport in low ambient light. At least a portion of the playing field for playing the sport is fluorescent as well as at least one of the playing objects on the playing field. The playing field and playing objects are subjected to ultraviolet light to illuminate the fluorescent portions thereof. The playing apparatus of the present invention is particularly adapted for bowling when at least one of the pins of a rack of pins is fluorescent as well as portions of the bowling lane. Additionally, the bowler apparel and portions of the bowling ball may be fluorescent. These features are combined to improve the overall appeal and participation of the sport.

15 Claims, 5 Drawing Sheets

METHOD AND APPARATUS FOR BOWLING IN MINIMAL AMBIENT LIGHT

BACKGROUND OF THE INVENTION

1. Field of the Invention

The present invention relates to sporting apparatus having fluorescent playing elements therein. More specifically, the present invention relates to a bowling apparatus having fluorescent elements for bowling in low ambient light.

2. Background Information

Over the past several decades, the sport of bowling has experienced a decline in participation. Additionally, bowling centers have certain time periods in which it is very difficult to significantly fill the bowling center. The objects of the present invention are to provide a fun and exciting environment for bowling to alleviate the aforementioned problems. However, any changes to a conventional bowling center have significant limitations with which to consider. The changes cannot affect the normal operation of the bowling center. Furthermore, the fundamentals of the game of bowling should be maintained in any modifications.

SUMMARY OF THE INVENTION

The objects of the present invention are achieved by providing a bowling apparatus for bowling in low ambient light with the bowling apparatus including at least one bowling lane wherein at least a portion of the surface of each bowling lane is fluorescent. A rack of bowling pins is positioned in each lane with at least one of the pins of the rack having at least a partially fluorescent exterior surface. The bowling apparatus of the present invention will additionally include a bowling ball and a means for subjecting each bowling lane and associated rack of pins to ultraviolet light, whereby the fluorescent exterior surface of the pins and the fluorescent surfaces of the bowling lane will be illuminated, creating a unique and entertaining environment for bowling.

The bowling apparatus of the present invention may further include bowler apparel having fluorescent exterior surfaces. The fluorescent bowler apparel may include, for example, shirts, shorts, socks, visors, hats, sunglasses, wristbands and shoes. The fluorescent portions of the bowling lane surfaces may include the foul line and the lane arrows. The present invention may further include providing fluorescent portions on an exterior surface of the bowling ball, such as by attaching fluorescent decals thereto.

The bowling apparatus of the present invention may further include a room containing a plurality of bowling lanes wherein at least a portion of the walls and ceiling of the room are also fluorescent. At least one mirrored ball may be suspended from the ceiling above the lanes with a spotlight illuminating each mirrored ball. Furthermore, at least one fog machine may be positioned in the room. The device for subjecting each rack of pins to ultraviolet light may include an ultraviolet light over a pin deck of each lane.

The present invention can easily be expanded beyond bowling. Specifically, the present invention is applicable to sports having a defined playing field with at least one playing object thereon. An extension of the present invention includes a pool table with fluorescent portions thereon, including a fluorescent cue ball, a fluorescent rack of pool balls and a fluorescent cue stick.

The present invention also includes a method for training a bowler wherein the fluorescent material is applied on a plurality of positions on the bowler. By illuminating the bowling environment with ultraviolet light, the bowler's form may be more easily viewed and analyzed by the illumination of the fluorescent material. This method can highlight the kinematic parameters needing to be addressed while removing the extraneous visual information which would be present if bowling under ambient light. Additionally, the training method according to the present invention may provide positioning fluorescent material on the bowling ball in a manner which will indicate the axis of spin of the ball during bowling.

These and other objects of the present invention will be clarified in the description of the preferred embodiments taken together with the attached figures.

BRIEF DESCRIPTION OF THE PREFERRED EMBODIMENTS

Figure 1:
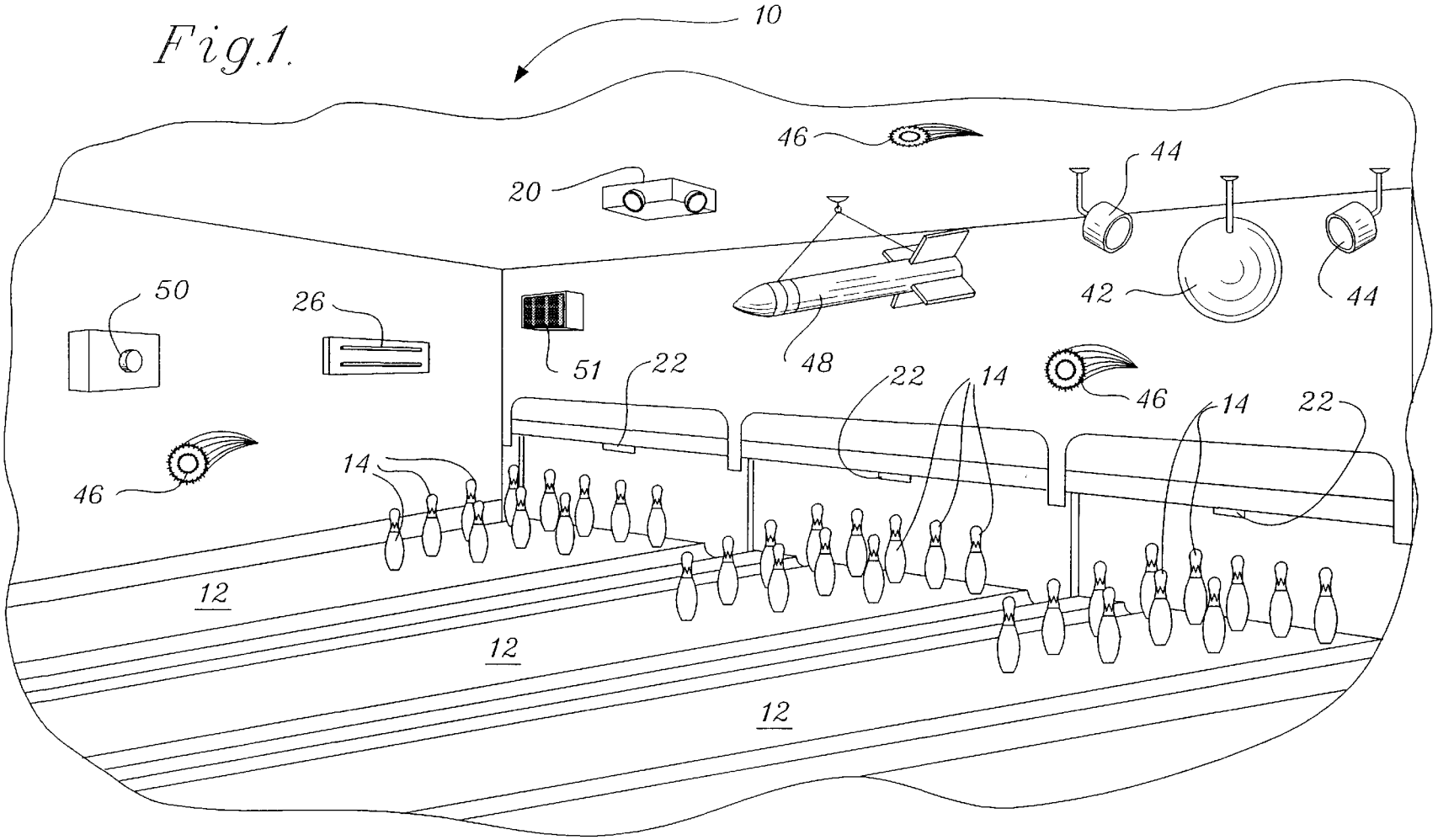
FIG. 1 is a perspective view of a bowling center according to the present invention.

FIG. 1 illustrates a perspective of a bowling center according to the present invention. The bowling center includes a room 10 having a plurality of bowling lanes 12 positioned therein, customarily in a side-by-side fashion across the length of the room 10.

A rack of bowling pins 14 is positioned in each lane. With the use of automated pin-setting machines (not shown), a rack of bowling pins 14 is often greater than the ten pins 14 which are in play at any given time. The excess pins 14 would be cycled through the automatic pin-setting machine in a customary fashion. According to the present invention, at least one of the pins 14 of the rack has a partially fluorescent exterior surface. Within the meaning of the present application, fluorescent refers to the ability to emit visible light (i.e., glow) when subjected to ultraviolet light. The fluorescent exterior surface on the pins 14 may be a single color, combination of colors or a pattern.

The conventional white bowling pins that are on the market today are not fluorescent. However, Perry-Austen International Inc. produces a variety of different colored and designed special event pins, some of which are fluorescent. The pin-making process is easily adapted to make any of the pin colors fluorescent by adding appropriate ultraviolet-sensitive additives to the coatings. It will be apparent that it would be necessary to cover the ultraviolet-sensitive layer on the pin 14 with a wear-resistant layer; otherwise, the fluorescent portion would quickly wear off.

Figure 3:
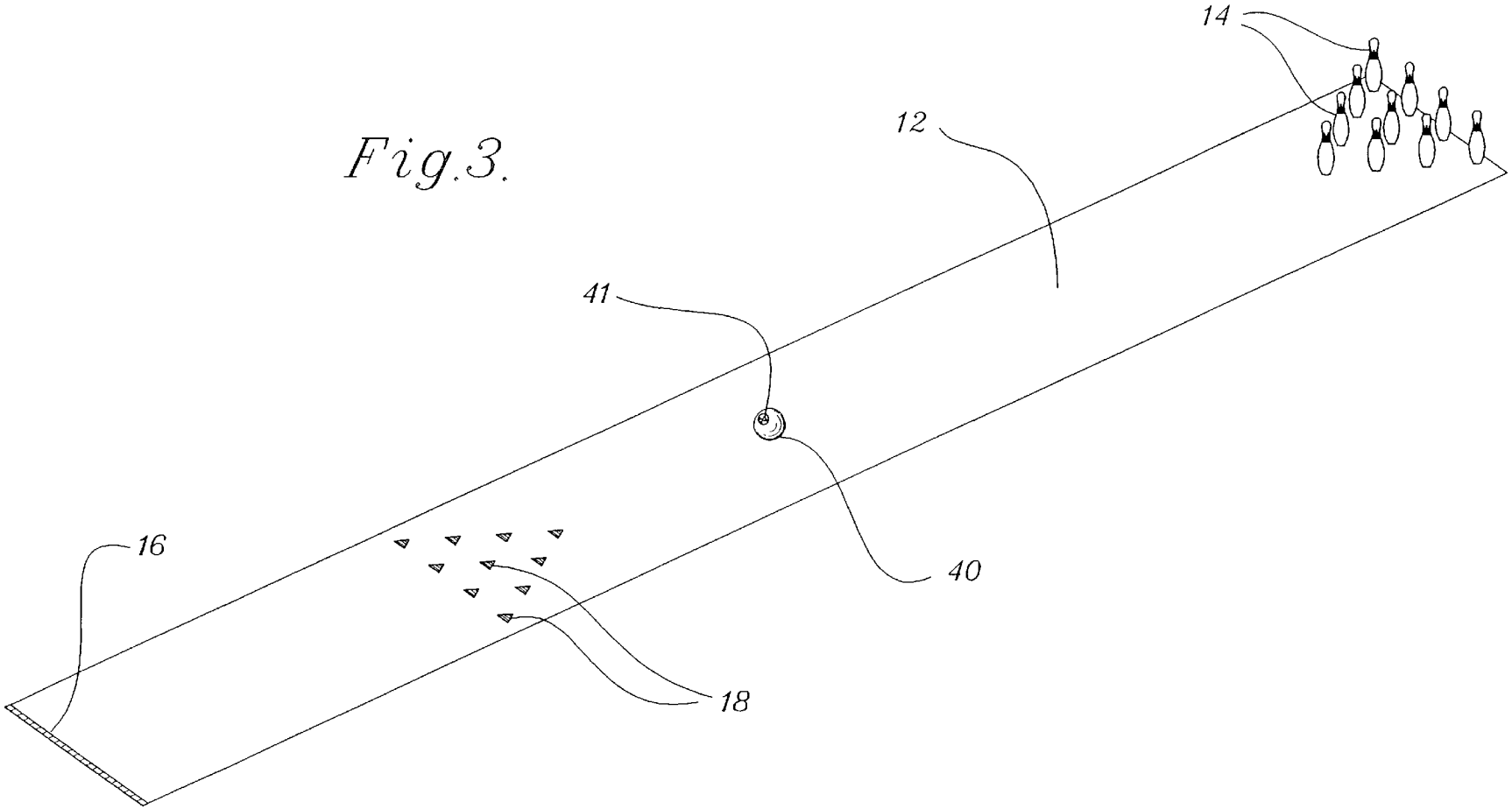
FIG. 3 is a schematic perspective view of a bowling lane in the bowling center illustrated in FIG. 1.

Each bowling lane 12 includes a foul line 16 and lane arrows 18 shown in FIG. 3 positioned in a conventional fashion. According to the present invention, the foul line 16 and lane arrows 18 are coated with a fluorescent material. The fluorescent material can comprise a fluorescent paint which, preferably, is translucent under ambient light. Acrylic fluorescent theatrical paints have been found to be sufficient. Appropriate paints are supplied by Wildfire Inc. The degree of fluorescence for the foul line 16 and lane arrows 18 need not be as significant or bright as preferred for the pins 14.

The foul line 16 and lane arrows 18 need only be sufficiently fluorescent so as to be visible to the bowler when subjected to the ultraviolet light.

Figure 2:
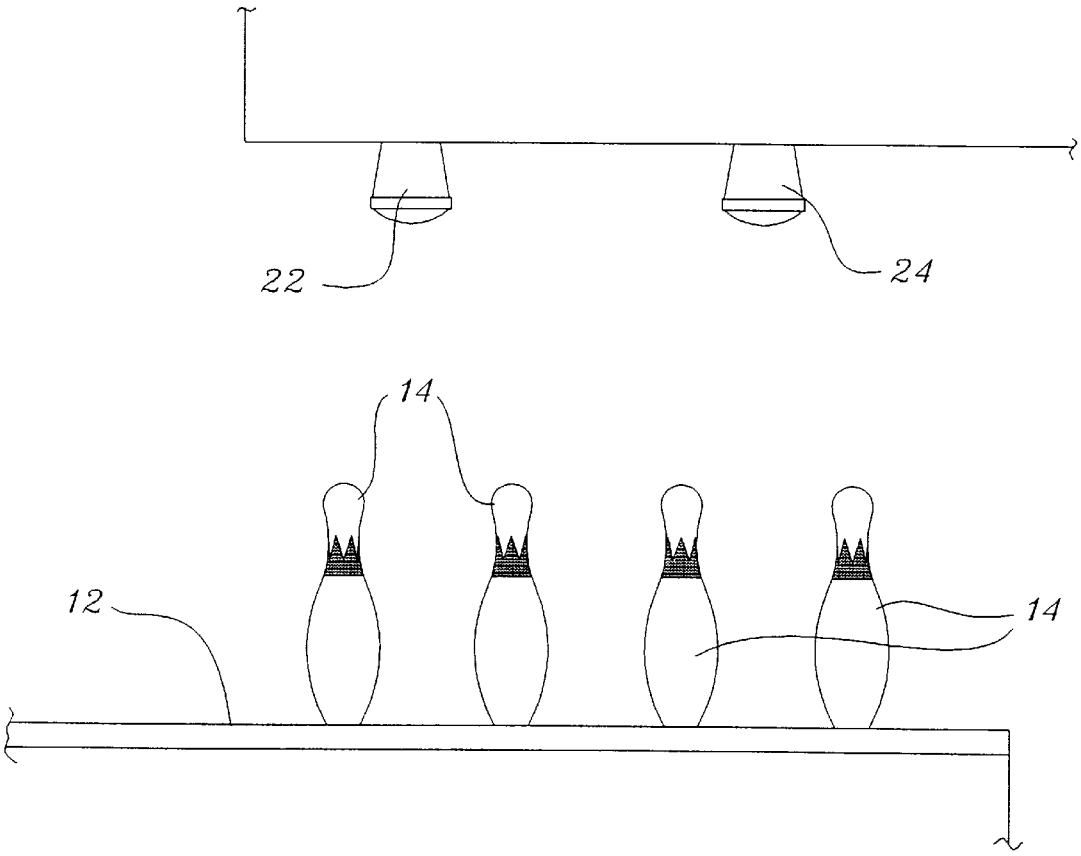
FIG. 2 is a side view of a pin deck of a bowling lane in the bowling center illustrated in FIG. 1.

The room 10 according to the present invention includes sufficient devices to illuminate the room 10 with ultraviolet light. These devices may include one or more ultraviolet flood lights 20 which can be used to illuminate fluorescent materials at distances over 100 feet. Samples of such flood lights are manufactured by Wildfire Inc. and are useful for saturating a large area with ultraviolet light. Another device for exposing the room 10 to ultraviolet light is a series of ultraviolet pin deck lights 22 positioned in the pin deck of each lane 12, as best shown in FIG. 2. The pin deck area of a bowling lane is directly over top of the rack of pins 14 and generally includes the pin-setting machine. As shown in FIG. 2, the ultraviolet pin deck lights 22 are positioned adjacent regular pin deck lights 24. The provision of both regular pin deck lights 24 and ultraviolet pin deck lights 22 above each pin deck allows for the bowling center to switch between regular operation and operation according to the present invention. The ultraviolet pin deck lights 22 and the regular pin deck lights 24 are preferably positioned adjacent each other along the centerline of each bowling lane 12.

As shown in FIG. 1, ultraviolet tubes 26 can be positioned at various locations around the room 10 to provide additional ultraviolet light as needed.

Figure 4:
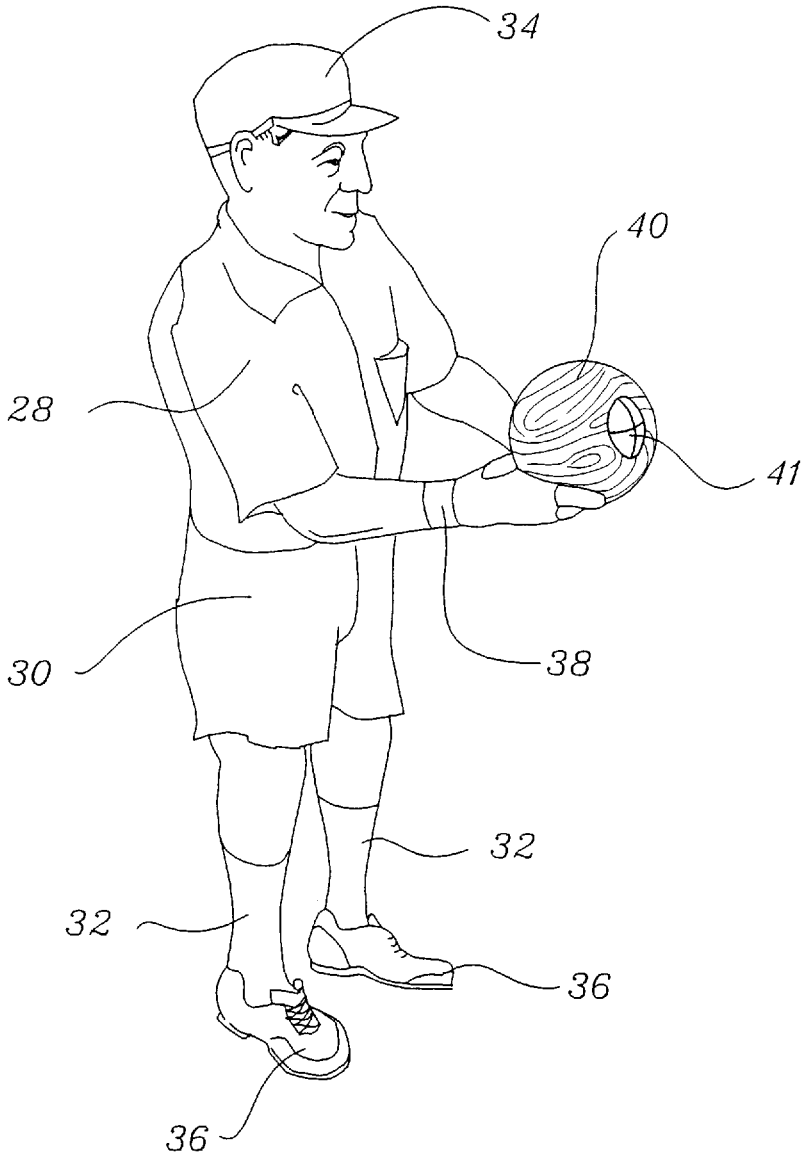
FIG. 4 is a side view of a bowler and bowling lane according to the present invention.

Various bowler apparel and accessories can be provided with fluorescent surfaces and designs thereon. As shown in FIG. 4, this fluorescent clothing can include shirt 28, shorts 30, socks 32, hat 34, shoes 36 and wristband 38, all with a fluorescent design. Various additional fluorescent accessories can be provided, such as visors, gloves, necklaces, sunglasses, shoelaces, towels or the like. These fluorescent accessories could be supplied as iron-on fluorescent decals, such as for the fluorescent shirts 28. The bowling shoes 36 can be provided with fluorescent shoelaces and decals for illumination in ultraviolet light. The use of fluorescent shoelaces and decals for shoes 36 allows a bowling center to utilize the existing stock of bowling shoes rather than investing in an entire supplemental fluorescent stock.

The fluorescent wristband 38, together with fluorescent shoes 36, illustrate the instructional aspects of the present invention. The fluorescent bowling apparatus according to the present invention may be utilized to train a bowler from beginner to advanced levels. Fluorescent material, such as wristband 38 and shoes 36, is positioned at a plurality of important key kinematic positions on the bowler. Then, by reducing the amount of ambient light in the bowling environment and illuminating the bowling environment with ultraviolet light, such as by the ultraviolet flood lights 20, ultraviolet pin deck lights 22 and ultraviolet tubes 26, only the fluorescent material will be clearly visible. In this manner, the extraneous visual elements will be eliminated or reduced and the bowler and/or trainer can concentrate on observing the highlighted key positions of the bowler. For example, with the use of the fluorescent wristband 38 and fluorescent shoes 36, the bowler and/or the trainer can concentrate on proper movement of the arm in conjunction with the feet during the approach.

The bowling ball 40 may be provided with fluorescent decals 41 thereon, as illustrated in FIGS. 3 and 4. The provision of fluorescent decals 41 on the bowling ball 40 will enhance the overall visual effect of the fluorescent bowling apparatus according to the present invention. Additionally, the proper positioning of the decals on the bowling ball 40, such as two diametrically opposed fluorescent decals 41, can aid in the training of a bowler. Positioning of such diametrically opposed fluorescent decals 41 will allow a bowler to easily observe the axis of spin which is generated. The specific axis of spin of a bowling ball is not readily determined in conventional bowling. However, with the provision of diametrically opposed fluorescent decals 41 on the bowling ball 40 and the subjection of the bowling environment to ultraviolet light, the axis of spin of the bowling ball 40 can be easily and visibly determined. Specifically, the axis will be illustrated as being surrounded by two fluorescent bands with each band being formed by one of the fluorescent decals 41 spinning around the axis.

Aside from the training aspects of the present invention, the present invention provides a fun and entertaining atmosphere for bowling. To enhance the entertaining atmosphere created by the ultraviolet bowling apparatus described above, one or more mirrored balls 42 may be suspended from the ceiling of the room 10 above the lanes 12. Each mirrored ball 42 will be spot-lighted by one or more spotlights 44 to create the sparkling mirrored ball effect. Further enhancing the environment are fluorescent patterns 46 attached to the walls and ceiling of the room 10 as well as other decorations 48 suspended from the walls and ceiling of the room 10. Fogging machines 50 and sound system 51 may be provided to further enhance the overall atmosphere.

Additional lighting effects, such as colored spotlights, rotating star lights and the like, may also be provided to enhance the bowling environment. The fogging machine 50 and various lighting equipment are available from Martin Professional, U.S.A., INC. and similar lighting equipment is supplied by American DJ Supply, Inc.

Figure 5:
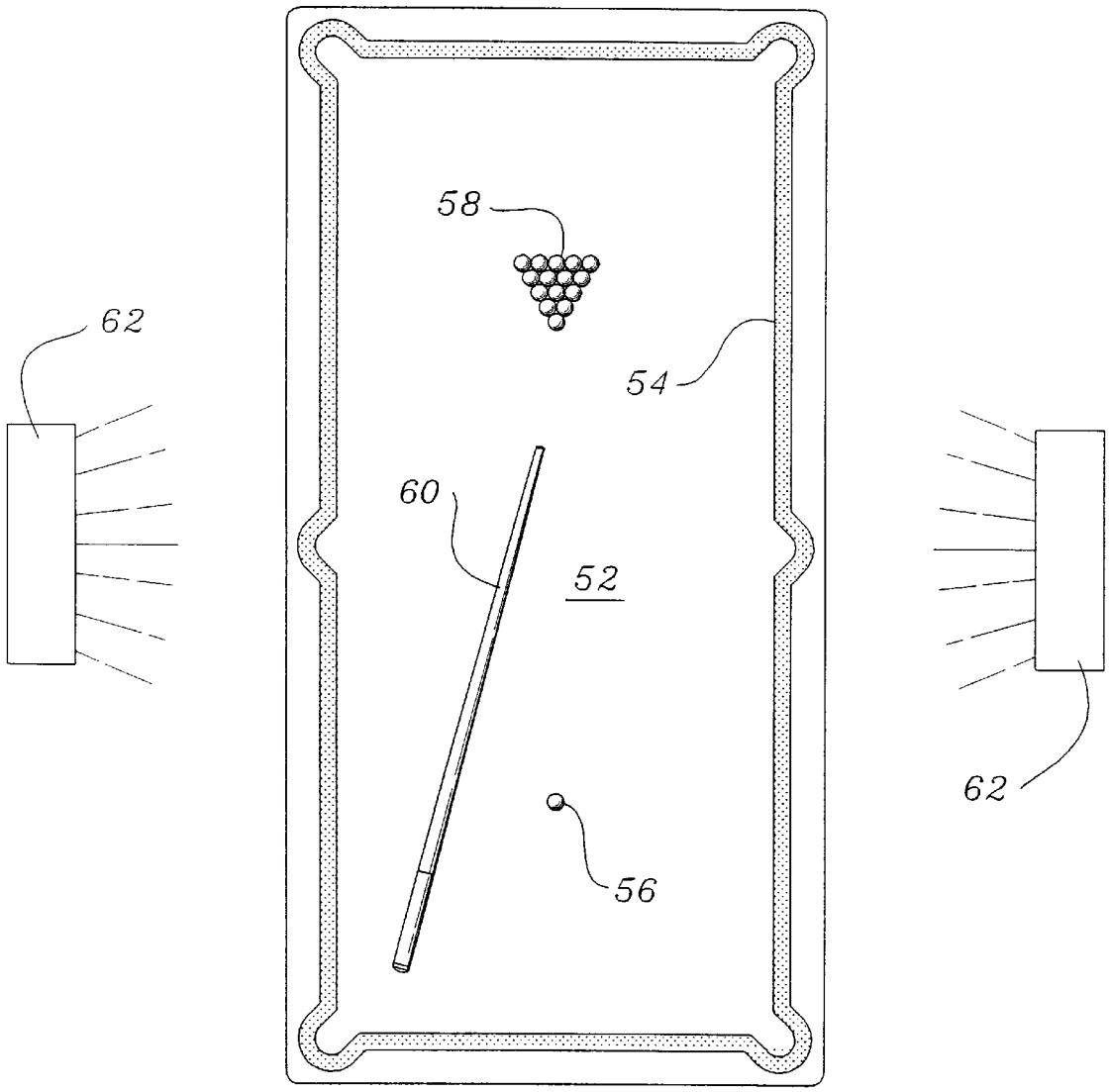
FIG. 5 is a schematic plan view of a pool table according to the present invention.

FIG. 5 illustrates another aspect of the present claimed invention. Historically, the game of pool or pocket billiards has been closely related to that of bowling, largely because many bowling equipment manufacturers are also associated with pool. The fluorescent bowling apparatus described above translates exceptionally well to the game of pool. A pool table 52 according to the present invention is illustrated in FIG. 5. The outline 54 of the pool table 52 extending along the rails and around the pockets of the pool table 52 is provided with fluorescent material, such as acrylic fluorescent paint. The diamonds (not shown) may also be made fluorescent. Additionally, the cue ball 56 and remaining balls 58 also have a fluorescent exterior. Cue stick 60 also includes a fluorescent exterior along the substantial length thereof. Ultraviolet lights 62 can be used to illuminate the pool table 52. These lights 62 can preferably take the form of ultraviolet tubes positioned in a fixture directly over top of the pool table 52. The pool table 52 according to the present invention fits in well with the bowling environment described above since many bowling centers include at least one pool table. It is anticipated that the pool table 52 would be positioned within the room 10.

As described previously, the fluorescent bowling apparatus of the present invention is not limited to bowling and has applications for use in training. However, the primary purposes of the fluorescent bowling apparatus of the present invention are to provide an entertaining and fun atmosphere for bowling participants and spectators alike. With the bowling apparatus of the present invention, it is hoped that overall public participation and spectator appeal of the sport of bowling can be increased. Additionally, the present invention is intended to allow conventional bowling centers to offer an alternative type of bowling without significant rearrangement or destruction of the bowling lanes.

It will be appreciated by those of ordinary skill in the art that various modifications may be made to the present invention without departing from the spirit and scope thereof. The scope of the present invention is intended to be defined by the attached claims.

What is claimed is:

1. A bowling apparatus for bowling in low ambient light, said bowling apparatus comprising:

a room containing a plurality of fluorescent bowling lanes wherein at least a portion of a surface of each said fluorescent bowling lane is fluorescent;

a rack of bowling pins positioned in each said fluorescent bowling lane, at least one of said pins of said rack having at least a partially fluorescent exterior surface;

a bowling ball;

a means for subjecting said room and each said fluorescent bowling lane and said rack of pins to ultraviolet light; and bowler apparel having fluorescent exterior surfaces, wherein said bowler apparel includes bowling shoes.

2. The bowling apparatus of claim 1 wherein said bowler apparel further includes a wristband.

3. A bowling apparatus for bowling in low ambient light, said bowling apparatus comprising:

a room containing a plurality of fluorescent bowling lanes wherein at least a portion of a surface of each said fluorescent bowling lane is fluorescent;

a rack of bowling pins positioned in each said fluorescent bowling lane, at least one of said pins of said rack having at least a partially fluorescent exterior surface;

a bowling ball, wherein said bowling ball is fluorescent on at least a portion of an exterior surface thereof and said fluorescent portion of said bowling ball comprises fluorescent decals attached thereto; and a means for subjecting said room and each said fluorescent bowling lane and said rack of pins to ultraviolet light.

4. A bowling apparatus for bowling in low ambient light, said bowling apparatus comprising:

a room containing a plurality of fluorescent bowling lanes wherein at least a portion of a surface of each said fluorescent bowling lane is fluorescent;

a rack of bowling pins positioned in each said fluorescent bowling lane, at least one of said pins of said rack having at least a partially fluorescent exterior surface;

a bowling ball; and a means for subjecting said room and each said fluorescent bowling lane and said rack of pins to ultraviolet light, wherein at least a portion of the walls and ceiling of said room are fluorescent.

5. The bowling apparatus of claim 4 further including at least one mirrored ball suspended from said ceiling above said lanes and a spotlight illuminating said mirrored ball.

6. The bowling apparatus of claim 4 further including least one fog machine in said room.

7. The bowling apparatus of claim 4 wherein said ultraviolet light means includes an ultraviolet light positioned over a pin deck of each said lane.

8. A method of bowling in low ambient light in a room containing a plurality of fluorescent bowling lanes, said method comprising:

providing at least one bowling pin having at least a partially fluorescent exterior of a rack of bowling pins for each said fluorescent bowling lane;

coating at least portions of each said fluorescent bowling lane with fluorescent material;

illuminating said room and each said fluorescent bowling lane and each said rack of pins with ultraviolet light, whereby said fluorescent surfaces of said pins and each said fluorescent bowling lane will be illuminated; and coating an exterior surface of at least a portion of a bowling ball with fluorescent material, wherein said coating of said bowling ball includes fluorescent decals attached to said bowling ball.

9. A method of bowling in low ambient light in a room containing a plurality of fluorescent bowling lanes, said method comprising:

providing at least one bowling pin having at least a partially fluorescent exterior of a rack of bowling pins for each said fluorescent bowling lane;

coating at least portions of each said fluorescent bowling lane with fluorescent material;

supplying bowler apparel having fluorescent surfaces thereon, wherein said fluorescent bowler apparel includes wristbands and shoes; and illuminating said room and each said fluorescent bowling lane and each said rack of pins with ultraviolet light, whereby said fluorescent surfaces of said pins and each said fluorescent bowling lane will be illuminated.

10. A method of bowling in low ambient light in a room containing a plurality of fluorescent bowling lanes, said method comprising:

providing at least one bowling pin having at least a partially fluorescent exterior of a rack of bowling pins for each said fluorescent bowling lane;

coating at least portions of each said fluorescent bowling lane with fluorescent material;

supplying fluorescent decorations on the walls and ceiling of the room containing said bowling lane; and illuminating said room and each said fluorescent bowling lane and each said rack of pins with ultraviolet light, whereby said fluorescent surfaces of said pins and each said fluorescent bowling lane will be illuminated.

11. The method of bowling as claimed in claim 10 further including the steps of:

suspending at least one mirrored ball from the ceiling of the room; and illuminating said mirrored ball with a spotlight.

12. The method of bowling as claimed in claim 11 further including the step of supplying fog from a fog machine to said room.

13. A method of training a bowler comprising the steps of:

supplying fluorescent material on a plurality of positions on the bowler;

minimizing ambient light in the bowling environment; and illuminating the bowling environment with ultraviolet light, whereby the bowler's form may be easily viewed and analyzed through illumination of said fluorescent material.

14. The method of claim 13 wherein said positions include the bowler's wrist and feet.

15. The method of claim 13 further including the step of coating at least a portion of the bowling lane with fluorescent material.

* * * * *

US005846138C1

(12) EX PARTE REEXAMINATION CERTIFICATE (7891st)

United States Patent
Borden et al.

(10) Number: US 5,846,138 C1
(45) Certificate Issued: Nov. 30, 2010

(54) METHOD AND APPARATUS FOR BOWLING IN MINIMAL AMBIENT LIGHT

(75) Inventors: Fred L. Borden, Akron, OH (US); James F. Mansfield, Akron, OH (US); Jerrylin D. Edwards, Akron, OH (US)

(73) Assignee: Glotek, LLC, Fairlawn, OH (US)

Reexamination Request:
No. 90/010,767, Mar. 12, 2010

Reexamination Certificate for:

| | |
|---|---|
| Patent No.: | **5,846,138** |
| Issued: | **Dec. 8, 1998** |
| Appl. No.: | **08/459,417** |
| Filed: | **Jun. 2, 1995** |

(51) Int. Cl.
*A63D 1/00* (2006.01)

(52) U.S. Cl. ..... 473/54; 473/115; 473/125; 273/DIG. 24

(58) Field of Classification Search ..... None
See application file for complete search history.

(56) References Cited

U.S. PATENT DOCUMENTS

| | | | |
|---|---|---|---|
| 280,807 | A | 7/1883 | Farley |
| 1,541,687 | A | 6/1925 | Cory |
| 1,747,556 | A | 2/1930 | Price |
| 3,125,536 | A | 3/1964 | O'Brien |
| 4,250,537 | A | 2/1981 | Roegner |
| 4,652,464 | A | 3/1987 | Ludlum |
| 4,712,319 | A | 12/1987 | Goria |
| 4,982,601 | A | 1/1991 | Troxell |
| 4,990,290 | A | 2/1991 | Gill |
| 5,240,648 | A | 8/1993 | Gill |
| 5,417,438 | A | 5/1995 | Poff |

FOREIGN PATENT DOCUMENTS

| | | |
|---|---|---|
| FR | 2620039 | 9/1987 |
| FR | 2621493 | 10/1987 |

OTHER PUBLICATIONS

"Mazzitelle in 300 At Olympic Bowl," from BPA Bowler, May 24, 1962.

Wildfire Brochure.

Hightech Effects Brochure by American DJ Professionals.

*Primary Examiner*—Catherine S. Williams

(57) ABSTRACT

Sporting apparatus and environment are disclosed for playing a sport in low ambient light. At least a portion of the playing field for playing the sport is fluorescent as well as at least one of the playing objects on the playing field. The playing field and playing objects are subjected to ultraviolet light to illuminate the fluorescent portions thereof. The playing apparatus of the present invention is particularly adapted for bowling when at least one of the pins of a rack of pins is fluorescent as well as portions of the bowling lane. Additionally, the bowler apparel and portions of the bowling ball may be fluorescent. These features are combined to improve the overall appeal and participation of the sport.

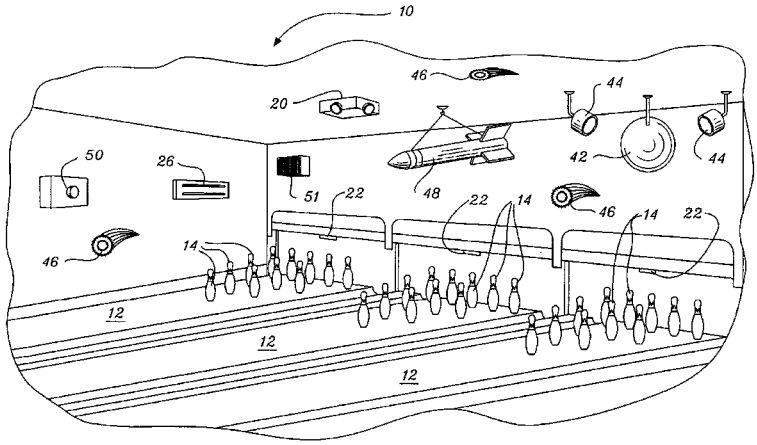

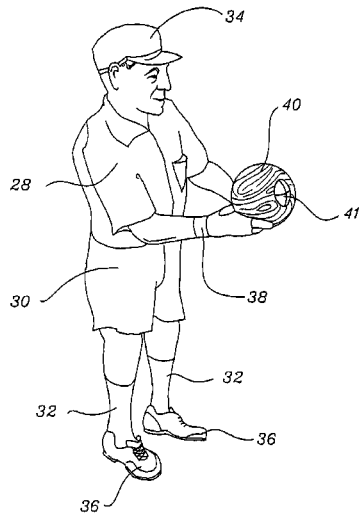

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-15 are cancelled.

* * * * *